US007273022B2

(12) United States Patent
Valdivia

(10) Patent No.: US 7,273,022 B2
(45) Date of Patent: Sep. 25, 2007

(54) CONCENTRIC PISTON FOR VARIABLE COMPRESSION RATIO DIRECTLY BASED ON THE COMBUSTION CHAMBER PRESSURE

(76) Inventor: Francisco Azocar Valdivia, c/o Schweitzer Cornman Gross & Bondell LLP, 292 Madison Ave., 19th Floor, New York, NY (US) 10017

( * ) Notice: Subject to any disclaimer, the term of this patent is extended or adjusted under 35 U.S.C. 154(b) by 0 days.

(21) Appl. No.: 11/359,663

(22) Filed: Feb. 22, 2006

(65) Prior Publication Data

US 2006/0249103 A1 Nov. 9, 2006

(30) Foreign Application Priority Data

Sep. 5, 2005 (CL) ..... 2278-2005

(51) Int. Cl.
*F02B 76/04* (2006.01)

(52) U.S. Cl. ..... 123/48 R; 123/193.6; 123/48 B; 92/84

(58) Field of Classification Search ..... 123/48 R, 123/41.35, 78, 78 AA, 48 B, 193.6; 92/84
See application file for complete search history.

(56) References Cited

U.S. PATENT DOCUMENTS

| | | | | |
|---|---|---|---|---|
| 1,546,243 | A * | 7/1925 | Kimmerling | 123/78 B |
| 2,323,742 | A * | 7/1943 | Webster | 92/84 |
| 3,704,695 | A * | 12/1972 | Cronstedt | 123/78 B |
| 4,031,868 | A * | 6/1977 | Karaba et al. | 123/78 B |
| 4,137,873 | A * | 2/1979 | Caswell, Sr. | 123/78 B |
| 4,241,703 | A * | 12/1980 | Lin-Liaw | 123/48 R |
| 6,223,703 | B1 * | 5/2001 | Galvin | 123/48 B |
| 6,907,849 | B2 * | 6/2005 | Galvin | 123/48 A |
| 2002/0104492 | A1 * | 8/2002 | Cowans | 123/48 R |

* cited by examiner

*Primary Examiner*—Stephen K. Cronin
*Assistant Examiner*—Katrina B. Harris
(74) *Attorney, Agent, or Firm*—Schweitzer Cornman Gross & Bondell LLP

(57) ABSTRACT

This invention produces a variable compression ratio in internal combustion engines, based on a sliding concentric piston which moves up by an internal spring and down by the different changing pressures over the concentric piston head, within the combustion chamber. This invention changes the compression ratio in an instantaneous and continuous way, depending directly on the pressure of the fuel mixture load in the combustion chamber.

10 Claims, 2 Drawing Sheets

CONCENTRIC PISTON FOR VARIABLE COMPRESSION RATIO DIRECTLY BASED ON THE COMBUSTION CHAMBER PRESSURE

FIELD OF THE INVENTION

In the field of the internal combustion engines, it has been very well established that the higher the compression ratio, the more intense the explosion phase of a determined load of fuel gas, what turns in a higher torque over the crankshaft and in the end more power generated by the engine.

A fix compression rate engines, has been the alternative utilized so far, what is not efficient given the big variability of the fuel gas loads in the combustion chamber, along with the different running conditions of the engine.

BACKGROUND AND SUMMARY OF THE INVENTION

Several alternatives have been proposed, which based on hydraulic pressures or mechanic actuators, modify the entire piston height or a part of it, but they are not able to react synchronically with the high speed of the changing pressures in the combustion chamber.

Given that those mechanisms are not directly connected to the pressures in the combustion chamber, they have an important delay in reference to the speed of change of the combustion chamber pressures which change at the piston speed, within the range of several thousand revolutions per minute that the engine works.

An additional problem arises with the alternatives that separate the piston crown by hydraulic mechanisms or mechanic actuators and also if a spring would be used, and it's that the piston crown would be under lateral forces generated by the pressures on the piston head against the resistance of the connecting rod to the crankshaft, which works inclining itself according to the crankshaft rotation. Those lateral forces would produce a high frequency desalignments among the skirts of the piston crown and that of the piston trunk.

That desalignment vibration would affect the coupling mechanism for the piston crown and the piston trunk, which are designed for vertical displacements only, so it's structural stability would be compromised.

Another important problem associated to those alternatives that separates the piston crown from the piston trunk, is that because the crown is the more massive part of the piston and it's inertia produces big impacts to stop it's movement at the top end and also at the bottom end against the trunk part.

The present invention permits a gradual adjustment of the compression ratio depending directly on the different pressures over the piston head, generated by the different fuel gas loads, in the combustion chamber, along the entire range of revolutions per minute of the engine work. More over, this invention doesn't have the problems mentioned before associated to the other alternatives.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF PREFERRED EMBODIMENTS

Figure 1:
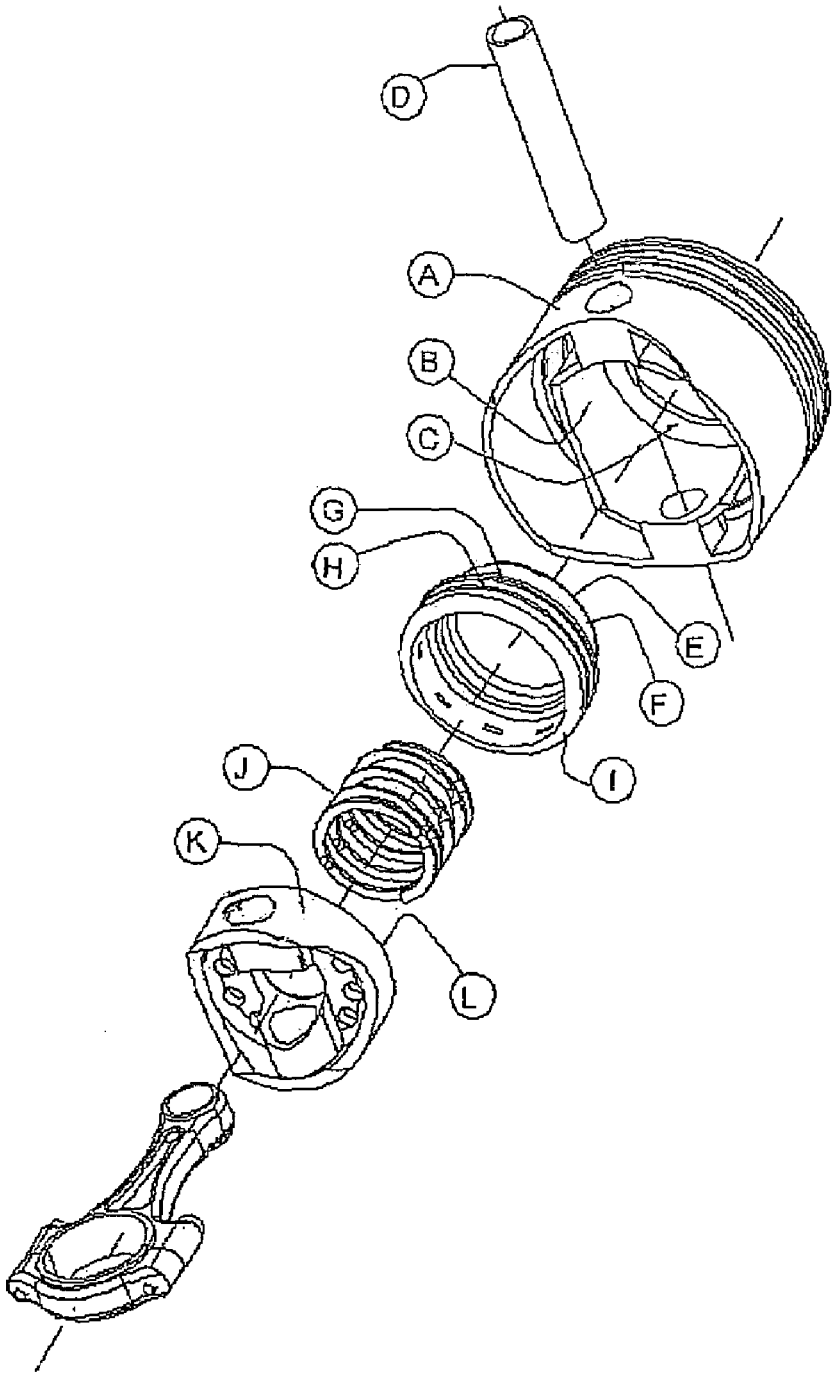
FIG. 1 is an exploded perspective view of the present invention.
Figure 2:
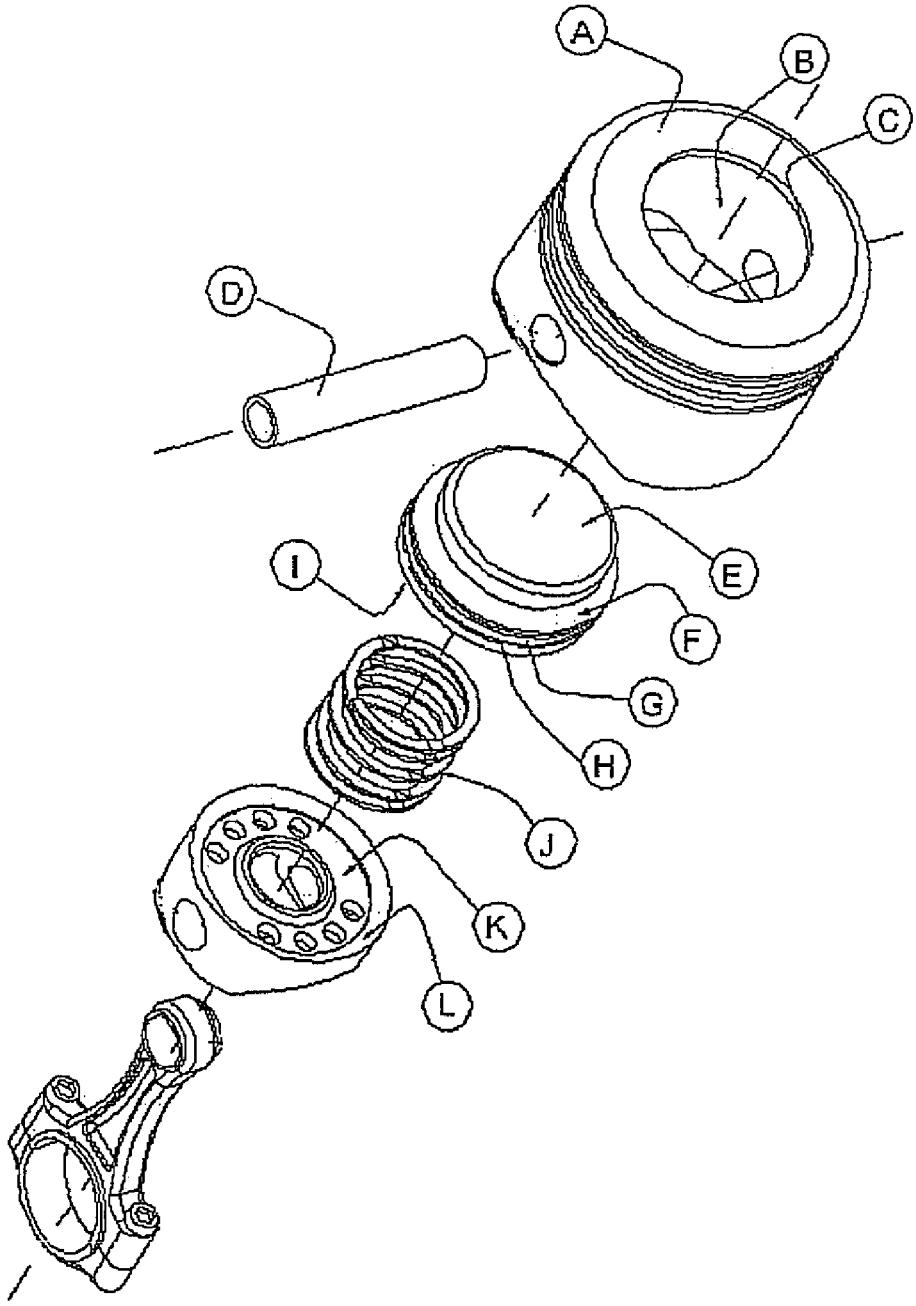
FIG. 2 is an exploded perspective view of the present invention.

The description of the invention will be based on the FIGS. 1 and 2.

This invention produces a variable compression ratio in internal combustion engines, based in a sliding concentric piston (E) which moves up by an internal spring (J) and down by the different changing pressures over the piston head, within the combustion chamber.

The concentric piston (E) slides on a cylindric hole (B) centered in the external piston (A) head. The internal concentric piston (E) has an upper conical shoulder (F) to seat smoothly on a conical seat (C) in the central cylindric hole (B) of the external piston (A), and a conical skirt base (I), to seat smoothly on a conical seat (L) on a support base ring (K), which remains fixed at the bottom of the central cylindric hole (B), by the same external piston pin (D), passing through a diameter oriented perforation in it. The same support base ring (K), supports the concentric piston internal spring (J).

This solution changes the compression ratio in an instantaneous and continues way, depending on the pressure of the fuel mixture load in the combustion chamber. The internal spring (J) pushes the concentric piston (E) up when the pressure over its head is low because of a low fuel mixture load, therefore increasing the compression ratio, and with a high load of fuel mixture, the pressure over the concentric piston head moves the concentric piston (E) down against the internal spring (J) force, producing a reduction of the compression ratio.

In the internal combustion engines engineering field, it is very well established that the higher the compression ratio, the stronger the explosion phase of a fuel mixture load and so, the higher the gas pressures in the combustion chamber pushing the piston during the working phase on the engine cycle. This means a better combustion efficiency and more torque and power generated.

With this solution the result is an optimized compression ratio for every situation of fuel mixture load at any moment during the compression phase, giving a better efficiency for every explosion phase. This better efficiency means relevant fuel savings and improved performance of torque and power over the entire revolutions range of the engine.

This invention is very simple in terms of it's components an it could be made of very light construction from the inertial stand point of it's functioning.

The concentric piston (E) could be made of a light material like titanium and considering that it would not support lateral forces, the skirt internal structure could be thin. The concentric piston has compression and lubrication rings slots (G) (H).

The support base ring (K) could also be made of a light and resistant material like titanium or teflon plastic, or a combination, like the support base made of titanium and the conical seat ring part (L), made of teflon for smoother concentric piston seating.

The internal spring (J) could be made of a flat section to optimize the space required for its compressed position.

The invention claimed is:

1. An assembly to modify in real time the compression ratio of internal combustion engines, comprising a concentric internal piston, an external or main piston having a cylindrical hole centered on its head with a conical seat at the upper end of its wall where the internal piston moves up and down and a spring base support ring having a conical seat on its outer upper face, the internal piston being on pushed up to the conical seat at the upper end of the cylindrical hole by the force of an inside spring supported by the base support ring which moves down to the conical seat on the same base support ring pushed by the changing pressures of the fuel mixture gas load in the combustion chamber.

2. The assembly as set forth in claim 1, wherein the internal piston has a conical upper shoulder, for a smooth seating against the conical seat at the upper end of the cylindrical hole in the external piston, at the end of the ascending movement.

3. The assembly as set forth in claim 1, wherein the conical seat at the upper end of the cylindrical hole in the external piston is a separated ring made of plastic material, like Teflon or others.

4. The assembly as set forth in claim 1, wherein the internal piston has its skirt lower border of a conical shape, to seat smoothly on the conical seat of the base support ring, at the end of the descending movement.

5. The assembly as set forth in claim 1, wherein the internal piston of that assembly has multiple slots on its skirt for compression and lubrication rings.

6. The assembly as set forth in claim 1, wherein the internal piston is made of light and resistant materials, like titanium, aluminum, alloys and also ceramics, to have low inertia under high engine speed and to resist the high temperatures and compression forces in the combustion chamber.

7. The assembly as set forth in claim 1, wherein the internal piston has clefts on its head, to keep enough space for the combustion chamber valves opening.

8. The assembly as set forth in claim 1, wherein the conical seat on the outer up face of the spring support ring is a separated ring made of a plastic material, like Teflon or others.

9. The assembly as set forth in claim 1, wherein the internal piston is made of a spiral shape, of rounded or flat section, or of a disc shape, or of a waved ring shape and it can be multiple.

10. The assembly as set forth in claim 1, wherein the base support ring, which is sustained in position at the bottom of the main piston central cylindrical hole by a diametrical perforation through which pass the same main piston pin, also has a central perforation to communicate the internal concentric piston space with the space below the main piston, to have access to the lubrication and cooling means of that environment and also has multiple holes on the support base to allow the recovery by gravity of the oil collected from the concentric piston interior.

* * * * *